United States Patent [19]

Corso et al.

[11] Patent Number: 5,006,269

[45] Date of Patent: Apr. 9, 1991

[54] CONTINUOUS PROCESS FOR PREPARING POWDER LUBRICANTS TO USE IN DRY WIREDRAWING AND/OR IN COLD METAL ROLLING

[75] Inventors: Angela N. Corso; Angelo Corso, both of Lecco; Carlo Corso; Antonio Corso, both of Malgrate, all of Italy

[73] Assignee: Lubrimetal S.p.A., Como, Italy

[21] Appl. No.: 268,176

[22] Filed: Nov. 7, 1988

[30] Foreign Application Priority Data

May 12, 1988 [IT] Italy ..... 20554 A/88

[51] Int. Cl.[5] ..... C10M 105/80

[52] U.S. Cl. ..... 252/39; 252/56 R; 72/42; 241/23; 241/25; 241/29; 241/65

[58] Field of Search ..... 252/39, 56 R; 241/23, 241/25, 29, 65; 72/42

[56] References Cited

U.S. PATENT DOCUMENTS

| | | | |
|---|---|---|---|
| 1,514,096 | 11/1924 | Nordstrom | 252/39 |
| 2,251,092 | 7/1941 | Williams | 72/42 |
| 2,349,708 | 5/1944 | Elder | 72/42 |
| 2,374,913 | 5/1945 | Beerbower et al. | 252/39 |
| 4,015,780 | 4/1977 | Hall | 241/23 |
| 4,029,495 | 6/1977 | Hirayama | 241/23 |
| 4,607,796 | 8/1986 | Enikolopov et al. | 241/25 |
| 4,808,245 | 2/1989 | Nishi et al. | 72/42 |

*Primary Examiner*—Jacqueline V. Howard

*Attorney, Agent, or Firm*—Laff, Whitesel, Conte & Saret

[57] ABSTRACT

The apparatus to put the process of the invention into practice comprises a silo 1 to dispense fat (oil), a duct 2 to feed in lime and optionally inert additives, a mixer 3 provided with a stirrer, at least a charging pot 4, a pocket vessel 5, a hopper provided with a distribution blade 6, a conveyor belt 7 continuously operating internally of the baking furnace, a baking furnace 8, a grid-type conveyor belt 9, a first crusher 10 and a mill 11. The powder lubricant obtained by said continuous process also has the advantage of exhibiting a better morphological appearance, more hardness and improved adhesion to the substrate to be lubricated.

7 Claims, 1 Drawing Sheet

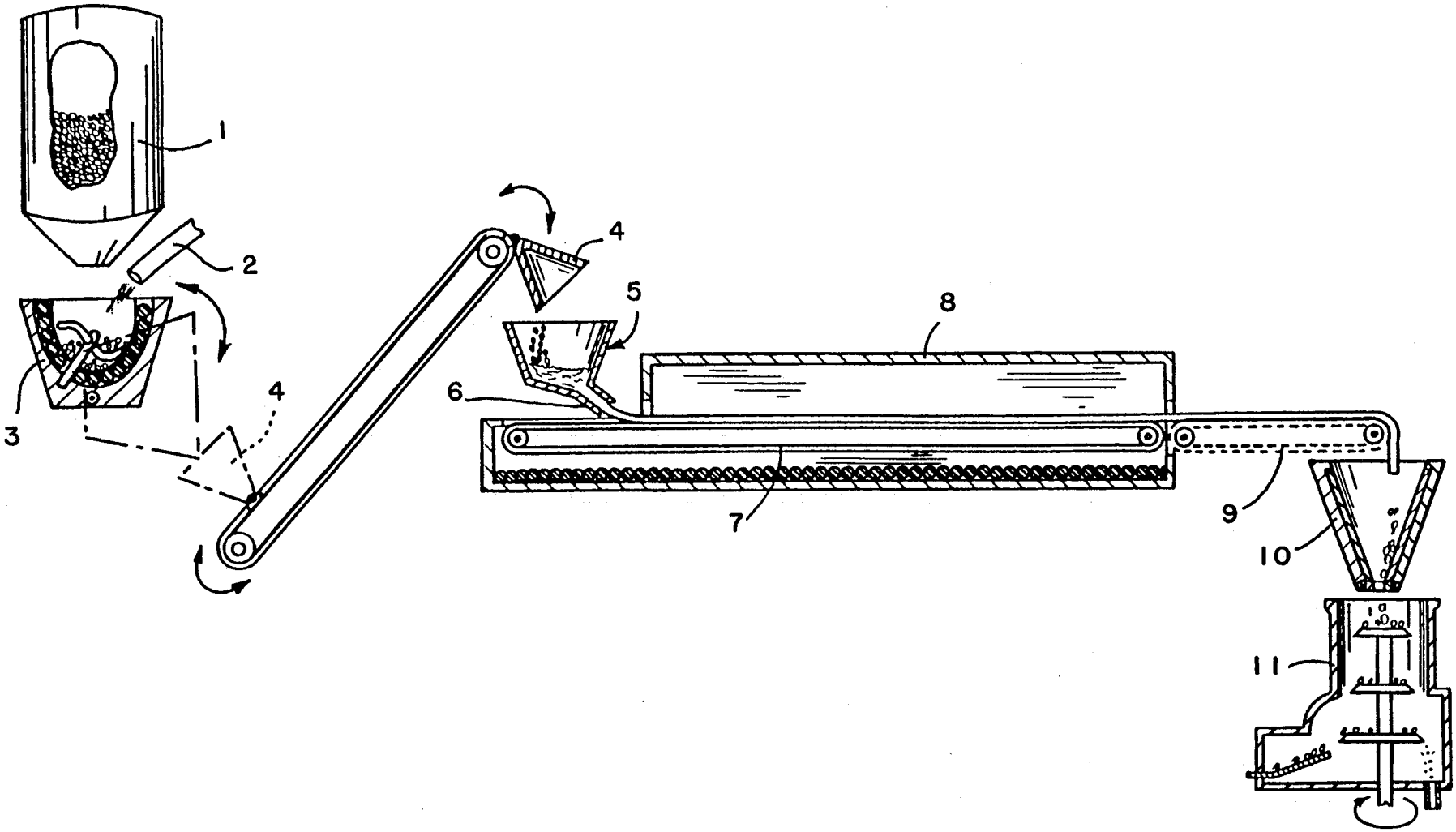
1
2
3
4
4
5
6
7
8
9
10
11

CONTINUOUS PROCESS FOR PREPARING POWDER LUBRICANTS TO USE IN DRY WIREDRAWING AND/OR IN COLD METAL ROLLING

FIELD AND BACKGROUND OF THE INVENTION

The present invention pertains to a process for continuously preparing powder lubricants to use in dry wiredrawing and/or in cold metal rolling, the apparatus to put the process into practice, and the powder lubricants thus obtained.

By wiredrawing it is generally meant a process in which a material being worked is cold deformed without removal of chips by pulling it through special matrices called dies so as to reduce its section up to the desired diameter or profile the section thereof according to the desired shapes.

Cold rolling is instead a process by which a material being worked is cold deformed without removal of chips by means of special rotating rolls. Obviously the friction of the wire through the die or rolls is in both cases very strong.

In order to eliminate or reduce said friction it is necessary to resort to lubrication, which consists in interposing substances which may be greasy, solid or liquid and are exactly called lubricants, between the sliding surfaces.

Currently, powder lubricants are increasingly used in the field of dry wiredrawing and/or cold rolling. They generally consist of metal salts of fatty acids added with inert mineral charges and additives.

The first wide-spread procedure to prepare powder lubricants consisted in mixing the components in a mixer until a homogeneous mass was achieved, then the product was distributed into appropriate tray-like containers and finally said containers were disposed in a furnace in which baking took place. The finished product thus obtained was then ground and brought to the desired granulometry.

It is clear that such a procedure needed very long working times, gave a reduced yield and involved an important waste of man-power and energy while offering insufficient security to the persons attending to the apparatus.

A further method of production substantially quicker and less hard than the preceding one, provides the use of a bladed mixer, heated to a temperature of 100° to 300° C., in which components are simultaneously mixed and baked during a period of time ranging between 60 and 90 minutes.

The mixture is afterwards taken out and then ground.

Although the last mentioned method is better than the preceding one, it suffers the disadvantage that at the end of the mixing and baking operations the production cycle must be interrupted to allow the discharging of the baked product and the charging of raw materials necessary for the next working cycle.

SUMMARY OF THE INVENTION

Consequently it was an object of the present invention to provide an apparatus and a process adapted to allow a continuous working, that is without any interruption in the production cycle, while at the same time giving a product identical to, or even better than, the one existing on the marked.

The above object has been surprisingly attained in accordance with the present invention by a continuous procedure using the apparatus shown in the accompanying figure in which down times are avoided as it is no longer necessary to wait for the material being discharged and therefore it is possible to remarkably increase the production yield.

It has also been surprisingly noted that, although the main object was that of eliminating the drawbacks connected with the batch processes requiring the production cycle to be stopped in order to allow the discharging of the product and the charging of raw materials, the product obtained by the present process was much better than that of the known art as regards morphological appearance, hardness and adhesion to the substrate.

Without wishing to build up a theory it can be assumed that in virtue of the process of the invention moisture content, low-boiling products and the products formed by condensation and oxidation reactions are eliminated or at least reduced and are not incorporated into the lubricant as it happens with other production methods.

The object of the present invention is therefore a process for the continuous preparation of powder lubricants to be mainly used in dry wiredrawing and/or cold rolling of metals, the lubricants thus obtained and an apparatus to carry out said process.

BRIEF DESCRIPTION OF THE DRAWING AND DETAILED DESCRIPTION OF THE PREFERRED EMBODIMENT

In the preferred embodiment of the present invention the apparatus to continuously prepare powder lubricants as shown in the drawing comprises: a silo 1 for the distribution of grease (oil), a duct 2 to feed in lime and inert additives if necessary, a mixer 3 provided with stirrer, at least a charging cup 4, a pocket vessel 5, a hopper provided with a distribution blade 6, a conveyor belt 7 continuously running internally of the baking furnace, a baking furnace 8, a grid-type conveyor belt 9, a first crusher 10 and a mill 11.

Referring to the drawing, for the accomplishment of the process of the invention from silo 1 and duct 2 grease, lime, and inert charges and additives where necessary, are brought to mixer 3. In the mixer temperature is adjusted to about 60°–70° C. with the aid of oil or another heating medium circulating in an outer jacket. After about 30 to 90 minutes the homogeneous product is discharged from the mixer so that it reaches the charging cup 4, then it goes into pocket vessel 5 and subsequently hopper 6. Meanwhile a new charge of raw materials is fed to mixer 3.

By means of the distribution blade 6 the mixture is spread on the conveyor belt 7 so as to form a thin layer having a uniform thickness which can however vary in the range of 0.5 to 3 cm. Thus the product reaches the baking furnace 8 which, depending upon the material being worked, is kept to a temperature varying between 180° and 350° C. In a preferred but not exclusive embodiment, the conveyor belt 7 at the inside of furnace 8 runs at a rate of 0.01 to 0.08 meters per second. However the temperature in the baking furnace and the running rate of the conveyor belt are not limitative to the ends of the invention.

On issuing from the baking furnace 8 the product slides on a grid-type conveyor belt 9 promoting the material cooling. Then the product reaches a first crusher 10 and afterwards a mill 11 which will give it the desired granulometry.

As starting products to be used in the process and apparatus of the invention we can mention: fat matters (oils or industrial greases of animal and/or vegetal origin), calcium hydroxide, inert mineral charges, lubricant additives (graphite, talc, molybdenum bisulphide, etc.), coloring pigments.

It is known that the decomposition of fats into glycerin and fatty acids is a hydrolysis which is carried out with the alkalic hydrates slightly in excess on the stoichiometric amount. As most fatty acids were and are used to prepare their alkalic salts called soaps, said hydrolysis of fats, and of esters in general, is called saponification.

It is also known that saponification can take place by pyrolysis with catalysts or not, by decomposition in an aqueous medium by an inorganic base or by hydrolytic decomposition at high temperature. In the process of the present invention saponification takes place with an excess of calcium hydroxide at high temperature and in a non-aqueous medium. This procedure offers the advantage that calcium soap is obtained immediately.

As already said, it is noteworthy the fact that the lubricant obtained by the process of the present invention exhibits, as compared with those of the known art, a better morphological appearance, more hardness and an improved adhesion to the substrate. It can therefore be assumed that the reaction carried out at high temperature on a thin and uniform layer, causes the elimination or at least the reduction of the moisture content, the glycerin released during the saponification reaction, the low-boiling products and the products formed by condensation and oxydation reactions so that all these products are not incorporated into the finished product.

The elimination or reduction of the above mentioned substances which is due to the particular thin-layer reaction of the invention, results in a raising of the melting point in the product and a lowering therein of substances detrimental to lubrication.

In this connection it is to be noted that the eliminated substances which could pollute the surrounding atmosphere are conveyed by forced suction to a combustion furnace where they are completely burnt thereby ensuring the ecological equilibrium required by the law. The present invention therefore represents an improvement with respect to the known art, because not only it allows to operate "continuously" without interruptions during the production cycle with all the advantages resulting therefrom, but it also gives a product which differentiates itself from the known ones due to a better morphological appearance, more hardness and improved adhesion to the substrate to be lubricated.

The following example serves to further illustrate the invention without however limiting it.

EXAMPLE 255 kg of fat are brought from silo 1 into a mixer heated to 60°-70° C., while 370 kg of calcium hydroxide, 200 kg of calcium carbonate and 30 kg of graphite are brought thereinto from duct 2. The mixing is carried out until a homogenous mass is achieved (about 50 minutes), then after the product has been poured into the charging pot 4 and subsequently into the pocket vessel 5 and hopper 6 in succession, a 1.20 cm thick layer of material is spread on the conveyor belt 7 by means of the distribution blade. The thin layer thus obtained travels along the baking furnace 8 inside which temperature is kept between 300° and 320° at a rate of 0.05 meters per second.

Mixer 3, when the mass thereof has been discharged into the charging pot 4, is ready to receive a new charge of fat, calcium hydroxide and optionally additives and inert substances, so as to ensure the continuous procedure which is the object of the present invention.

The product is then transferred from baking furnace 8 to the grid-type conveyor belt 9 where it is cooled, and then reaches the first crusher 10 and finally a mill 11 where it is ground to the desired granulometry. Next operations are ensiling and packaging in succession, 812.25 kg of product are obtained: yield 95%.

What is claimed is:

1. A process for continuously preparing powder lubricants for use in dry wiredrawings and in cold metal rolling comprising the steps of:

a. mixing lubricant fat and calcium hydroxide until a homogenous product is obtained;

b. continuously distributing said homogenous product as a thin layer on a conveyor belt;

c. continuously baking the homogenous product on the conveyor belt while the belt conveyor is moving;

d. after the baking, continuously cooling the homogenous product; and e. continuously pulverizing said cooled homogenous product.

2. The process as claimed in claim 1, wherein the mixer is kept at a temperature of 60° to 70° C. by making a fluid or another heating medium circulate in an outer jacket.

3. The process as claimed in claim 1, wherein a temperature ranging between 180° and 350° C. is established in a baking furnace.

4. The process as claimed in claim 3, wherein at an outlet of a hopper a distribution blade forms a thin and uniform layer of product having a thickness of 0.5 to 3 cm on said conveyor belt.

5. A process as claimed in claim 1 wherein the homogenous product is being transported on the belt conveyor at a speed ranging between 0.01 and 0.08 m/s.

6. A continuous method of preparing powdered dry wiredrawing and cold metal lubricants comprising:

feeding dry wiredrawing and cold metal lubricant materials to a mixer, said lubricant materials containing fat and calcium hydroxide;

heating said mixer to a temperature of about 60° to 70° C.;

mixing said lubricant materials in said mixer to obtain a homogenous product;

layering said homogenous product onto a conveyor with a thickness of 0.5 to 3 cm, passing said layered homogenous product on said conveyor through a heater to dry said layered homogenous product, cooling said dried layered homogenous product, and pulverizing said cooled homogenous product to produce said powdered lubricants.

7. The method of claim 6 wherein said dried homogenous product is transferred to a cooling grid-type conveyor and wherein said conveyor heater is at a temperature of between 180° and 350° C.

* * * * *